US008915311B2

(12) United States Patent
Belew et al.

(10) Patent No.: US 8,915,311 B2
(45) Date of Patent: Dec. 23, 2014

(54) METHOD AND APPARATUS FOR DRILLING A ZERO-RADIUS LATERAL

(75) Inventors: David Belew, Midland, TX (US); Jack J. Kolle, Seattle, WA (US); Mark H. Marvin, Tacoma, WA (US)

(73) Assignee: David Belew, Midland, TX (US)

( * ) Notice: Subject to any disclaimer, the term of this patent is extended or adjusted under 35 U.S.C. 154(b) by 482 days.

(21) Appl. No.: 13/329,015

(22) Filed: Dec. 16, 2011

(65) Prior Publication Data

US 2012/0160567 A1 Jun. 28, 2012

Related U.S. Application Data

(60) Provisional application No. 61/426,357, filed on Dec. 22, 2010.

(51) Int. Cl.

| | |
|---|---|
| ***E21B 7/18*** | (2006.01) |
| ***E21B 7/06*** | (2006.01) |
| ***E21B 17/05*** | (2006.01) |

(52) U.S. Cl.

CPC . *E21B 7/061* (2013.01); *E21B 7/18* (2013.01); *E21B 17/05* (2013.01)

USPC ..... 175/67; 175/77; 175/79

(58) Field of Classification Search

CPC ..... E21B 7/062; E21B 7/065; E21B 7/18

USPC ..... 175/67, 73, 75, 77–79; 166/55

See application file for complete search history.

(56) References Cited

U.S. PATENT DOCUMENTS

| | | | | |
|---|---|---|---|---|
| 5,911,283 | A * | 6/1999 | Cousins et al. | 175/78 |
| 6,220,372 | B1 | 4/2001 | Cherry | |
| 6,578,636 | B2 * | 6/2003 | Mazorow et al. | 166/298 |
| 6,755,249 | B2 * | 6/2004 | Robison et al. | 166/262 |
| 7,686,101 | B2 | 3/2010 | Belew et al. | |
| 2005/0252688 | A1 | 11/2005 | Head et al. | |
| 2006/0000644 | A1 * | 1/2006 | Adam et al. | 175/61 |
| 2009/0288884 | A1 | 11/2009 | Jelsma | |
| 2010/0108384 | A1 * | 5/2010 | Byreddy et al. | 175/27 |
| 2010/0187012 | A1 * | 7/2010 | Belew et al. | 175/62 |
| 2012/0067647 | A1 * | 3/2012 | Savage | 175/61 |

OTHER PUBLICATIONS

PCT Search Report and Written Opinion mailed Sep. 12, 2012 for PCT Application No. PCT/US11/66162, 12 pages.

* cited by examiner

*Primary Examiner* — Brad Harcourt
*Assistant Examiner* — Steven MacDonald
(74) *Attorney, Agent, or Firm* — Lee & Hayes, PLLC

(57) ABSTRACT

A jet drill coupled to a distal end of a flexible jet lance is lowered into a well casing and advanced through a curved passage formed in a deflection shoe oriented to direct the jet drill through an orifice milled in the well casing. The jet drill is actuated with a pressurized fluid produced by a pump on the surface that is conveyed through a high pressure hose that runs through the flexible jet lance. Force transmitted through a thrust liner of the jet lance advances the jet drill while the lateral bore is being drilled. The thrust liner comprises helical coils of steel wire providing a high elastic modulus and buckling resistance, even while passing through the curved passage. Tension cables in the jet lance maintain tension on the thrust liner and enable the assembly to be pulled from the lateral bore and well.

22 Claims, 6 Drawing Sheets

SECTION A-A

METHOD AND APPARATUS FOR DRILLING A ZERO-RADIUS LATERAL

RELATED APPLICATIONS

This application is based on a prior provisional application Ser. No. 61/426,357, filed on Dec. 22, 2010, the benefit of the filing date of which is hereby claimed under 35 U.S.C. §119 (e).

BACKGROUND

Oil and gas wells commonly bypass significant productive formations that may be uneconomic to complete at the time the well was drilled. These formations may be relatively thin and low pressure so simply perforating the zone does not provide significant new production. However, lateral drilling into such thin, horizontal oil bearing formations can result in substantial new oil production. The lateral well should be drilled at an angle as close as possible to 90 degrees relative to the vertical well to ensure that the lateral drilling tools stay within the productive zone. This objective can be accomplished by feeding a flexible lance equipped with a compact rotary jet drill though a shoe incorporating a curved passage that deflects the drill at a high angle into the formation. This approach is referred to as zero-radius lateral drilling, since the angle is defined entirely within the wellbore, as opposed to drilling a curved hole in the formation.

Conventional mechanical drilling requires high thrust and torque to penetrate rock. Applying high torque and thrust though a tight radius curve is extremely difficult. A rotary jet drill of the type described in U.S. Pat. No. 7,198,456 provides the ability to penetrate a range of underground formations with very low thrust load and no torque. The rotary jet drill includes a reaction-turbine jet rotor that spins a pair of forward facing jets that erode the formation. The jet drill face has a gage ring which, provided that the drill is kept pressed against the rock face, ensures drilling of a close tolerance circular section borehole.

It would be desirable to provide improved method and apparatus for zero-radius lateral drilling, for example, by using the rotary jet drill in a system that can apply the required torque and thrust through the tight curve defined within a borehole.

SUMMARY

This application specifically incorporates by reference the disclosures and drawings of each patent application and issued patent identified above.

This disclosure describes a jet drilling lance assembly that is capable of providing high-pressure fluid to power a rotary jet drill while providing sufficient thrust to maintain face contact while drilling and sufficient lateral stiffness to prevent the lance from buckling and diverting from a straight lateral trajectory. The invention further discloses a method for deploying the lance and drilling the lateral.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

DESCRIPTION

Figure 1A:
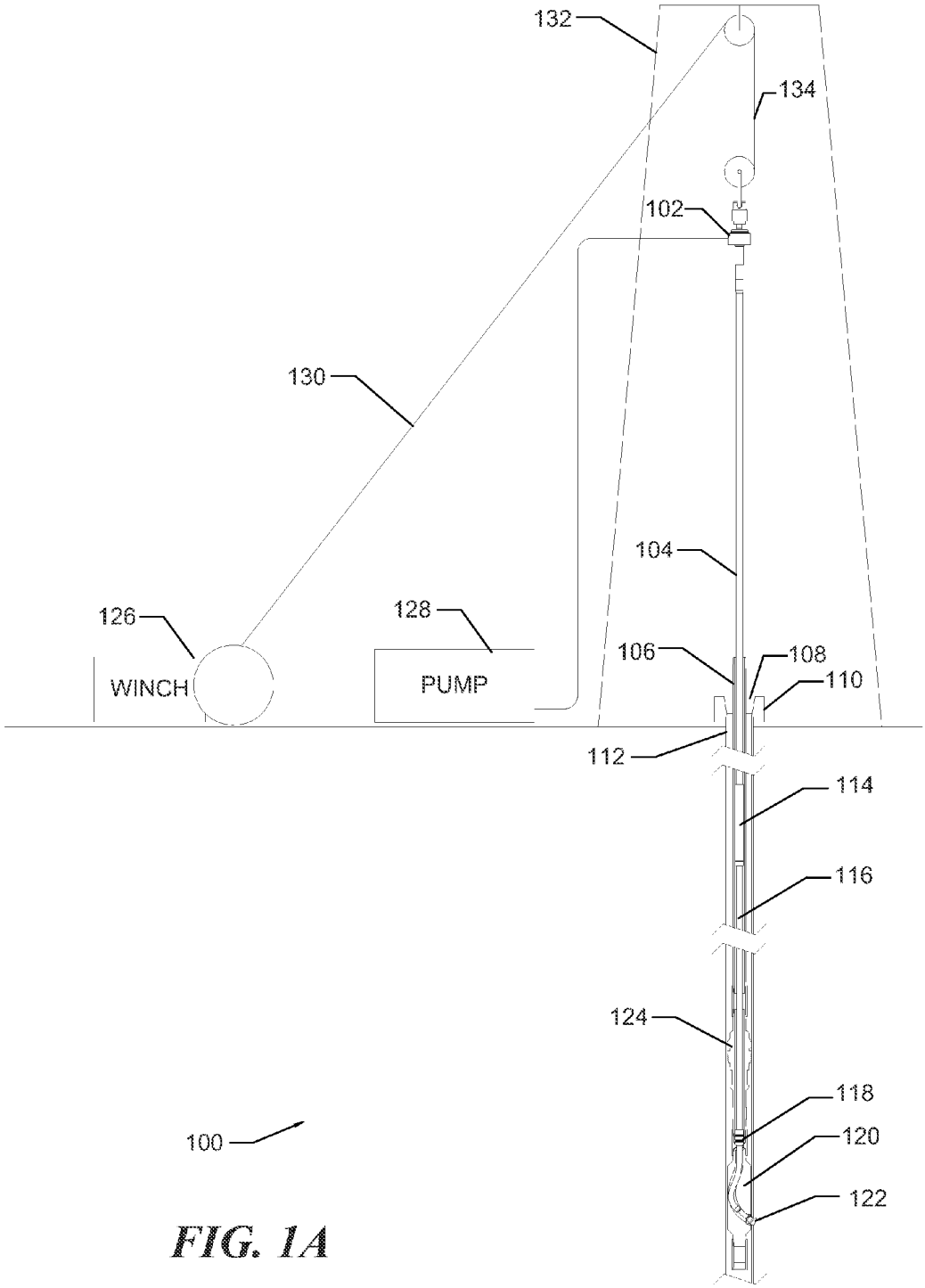
FIG. 1A shows an overview of the lateral drilling system at the start of drilling.

Figures and Disclosed Embodiments Are Not Limiting

Exemplary embodiments are illustrated in referenced Figures of the drawings. It is intended that the embodiments and Figures disclosed herein are to be considered illustrative rather than restrictive. No limitation on the scope of the technology and of the claims that follow is to be imputed to the examples shown in the drawings and discussed herein. Further, it should be understood that any feature of one embodiment disclosed herein can be combined with one or more features of any other embodiment that is disclosed, unless otherwise indicated.

Referring to FIG. 1A, a jet drilling assembly is shown in a casing 112 of a wellbore, in the earth 100. The jet drilling assembly is run into a guide tube 106, which is supported by slips 108 and casing 112. At the lower end of the guide tube, a packer 124 is removably set in the casing. In one exemplary embodiment, the packer is set in a desired position mechanically by rotation of the guide tube and is thereby locked in place within the casing by tension. The packer further supports a deflection shoe 120 that is distally disposed below the packer. The same guide tube, packer, and deflection shoe may be used to deploy a milling assembly to mill a window or orifice in the casing at the elevation where the lateral well is to be drilled, so that the lateral can be drilled by advancing the jet drill through the window so that it can drill into the surrounding formation. When the mechanical milling assembly used to mill the window is removed, the jet drilling assembly is run into the well through the guide tube without changing the position of the guide tube, or packer, so that the shoe maintains its alignment with the window. The jet drilling assembly comprises a high-pressure fluid swivel 102 on the surface, high-pressure tubing 104, a cable tensioner assembly 114, a flexible jet lance 116, and a jet drill 122.

The jet drilling assembly may be lowered into and raised out of the well with a winch 126, a cable 130, and a block assembly 134 that is supported on a frame 132. Pressurized fluid is supplied to the swivel from a pump 128. The use of swivel 102 enables rotation of the jet drilling assembly, which is suspended below in the bore, to orient the drilling assembly as desired. For example, the tubing string may be rotated with a pipe wrench that is applied to the string on the surface.

Figure 1B:
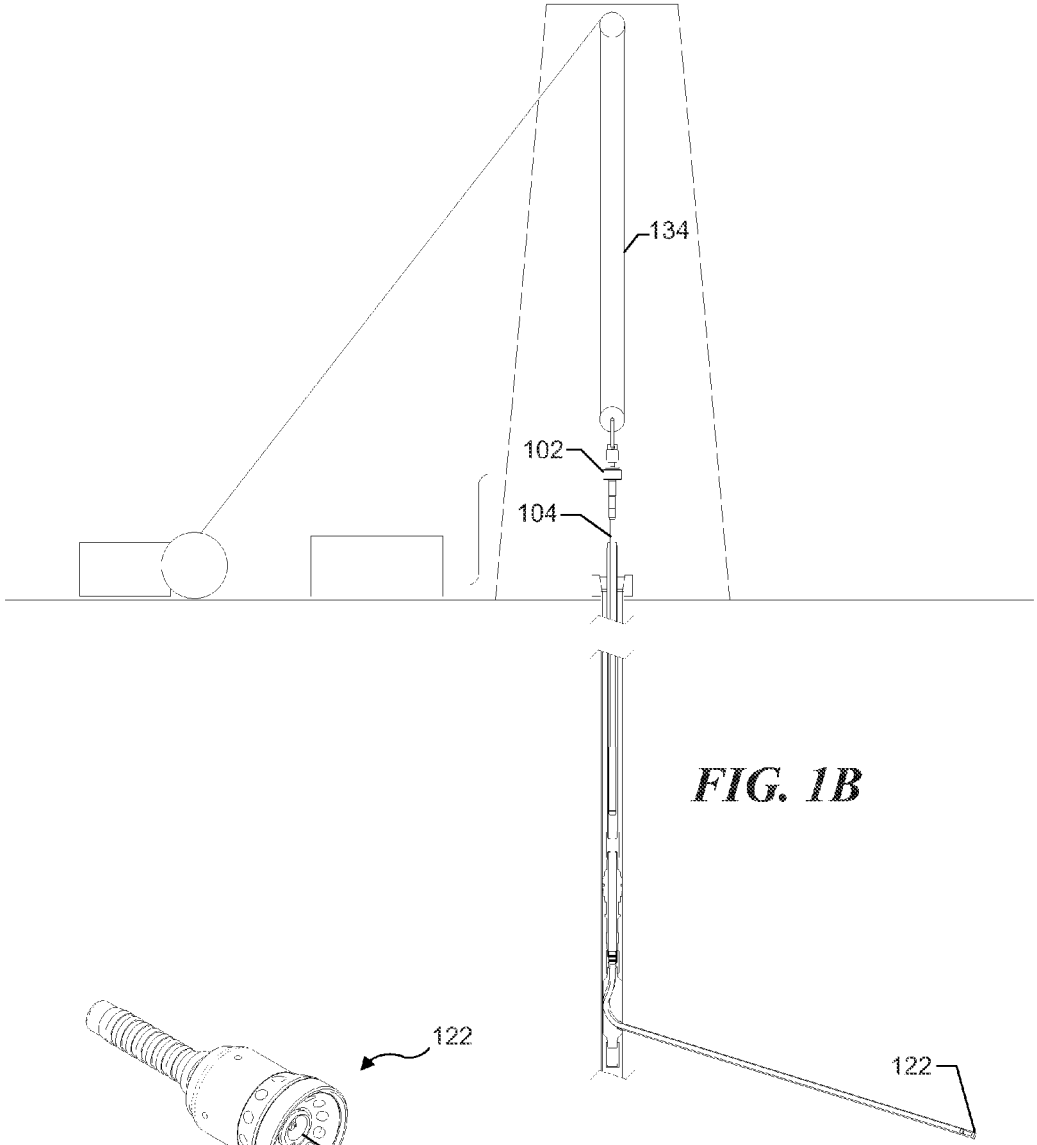
FIG. 1B shows the system after a portion of the lateral has been drilled.

FIG. 1B shows the lateral well drilled after the jet drilling assembly is lowered into the well. In an exemplary embodiment, the flexible jet lance is capable of passing though a 6-inch radius curve. For example, if the well casing diameter is 4.5-inches, the lateral well inclination is about 70 degrees from the casing axis. In wells having a larger casing, the same lance can drill a well at about 90 degrees inclination relative to the well axis.

Those skilled in the art will understand that various types of weight indicators are available and well known to observe the weight of the jet drilling assembly and high-pressure tubing. The weight is commonly calculated with an accuracy of about ±100 lbf. After the jet drill passes though the shoe and window in the well casing, it will tag the rock face, and the indicated weight of the jet drilling assembly and high-pressure tubing will drop. In one exemplary embodiment, the face of the jet drill is covered with a plastic cap that mechanically protects the jet drill during deployment and prevents wellbore fluid from flowing up into the assembly. Once the face of the jet drill with the cap in place tags the formation, fluid is pumped to the tool at high pressure. The jet of high pressure fluid at the drill will remove the cap and initiate drilling into the formation. The assembly is then fed into the formation, while maintaining nominal weight to ensure that the jet drill stays in contact with the formation.

Figure 2A:
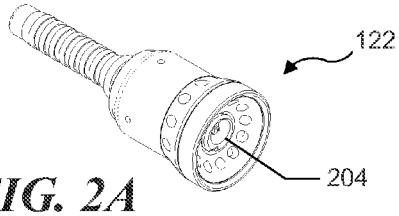
FIG. 2 shows a rotary jet drill.
Figure 2B:
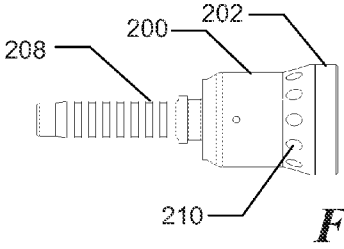
Figure 2C:
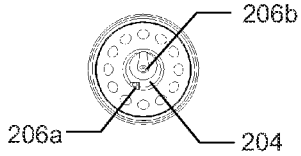

In one embodiment, jet drill 122 is a rotary type, such as disclosed in U.S. Pat. No. 7,198,456, and shown in FIGS. 2A, 2B, and 2C. This jet drill is capable of drilling a circular hole with a uniform diameter. The jet drill operates on high-pressure fluid, typically water, which can be supplied though a flexible, high-pressure hose. Shown in FIGS. 2A, 2B, and 2C are a housing 200, a gage ring 202, a rotor 204, and outer nozzle port 206*a* and inner nozzle port 206*b*. A hose barb 208 enables the nozzle to be attached to the end of a high-pressure hose using a crimp fitting. Nozzle port 206*a* directs a jet of fluid at an outer edge of the gage ring. The rotor rotates so that the outer jet erodes the rock at the outer circumference of the gage ring Inner nozzle port 206*b* directs a jet of fluid across the centerline of the rotor to erode the rock in the center of the hole. As disclosed in U.S. Pat. No. 7,198,456, this configuration enables drilling of a uniform diameter hole, provided that the distal edge of the gage ring is kept in contact with the rock face. Ports 210 are provided to enable rock cuttings and fluid to escape the face where the pressurized jets are drilling into the formation, for transport up the annulus between the hose lance and the borehole. The jet drill requires that a nominal thrust be applied toward the formation to overcome the thrust generated by the jets and to ensure that the face of the jet drill is kept pressed against the rock being cut. In one exemplary embodiment, the jet drill produces a 1.125-inch diameter hole using a hose lance outer diameter of about 1 inch.

Figure 3:
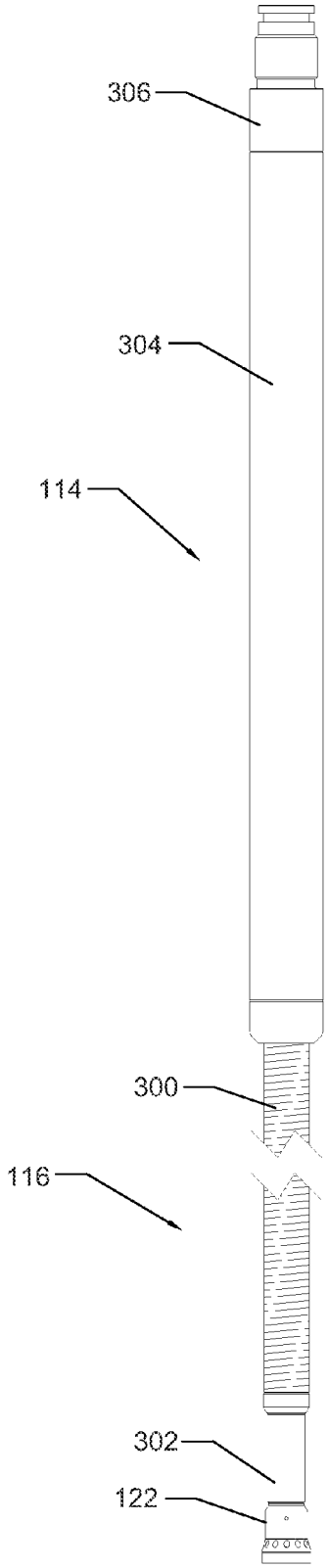
FIG. 3 shows a jet lance and cable tensioner.
Figure 5:
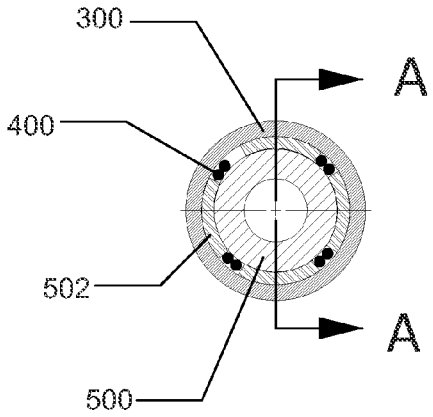
FIG. 5 shows a detailed section of the jet lance.

The jet drill is coupled to a distal end of flexible jet lance 116, which is coupled to a distal end of tensioner assembly 114, as shown in FIG. 3. Referring to FIG. 5, the flexible jet lance includes an inner high-pressure hose 500 through which pressurized fluid is supplied to the jet drill, spacers 502, tension cables 400, and a thrust liner 300.

High-pressure hose 500 can be of a multilayer wire-wrap or wire mesh reinforcement wrapped around an impermeable inner liner. Those skilled in the art will recognize that these types of hoses are capable of withstanding high pressure, while maintaining flexibility, without significant changes in diameter or length due to the applied fluid pressure. In one exemplary embodiment, a 6-layer hose capable of withstanding continuous operation at 20,000 psi is used.

Spacers 502 are arc shaped and are disposed between the high-pressure hose and the outer thrust liner 300 to form a slip fit. In one exemplary embodiment, four spacers are provided and disposed so that they are equally spaced apart around the hose. Alternate arrangements with more or fewer spacer segments can instead be used. The spacer can be constructed of a high-shear-strength polymer, such as nylon or acrylonitrile-butadiene-styrene (ABS), which is capable of withstanding immersion in water and oil and heating to temperatures of 100° C. or more. Longitudinally reinforced polymer with transverse flexibility, but high transverse shear strength, may also be used for the spacers.

Figure 6:
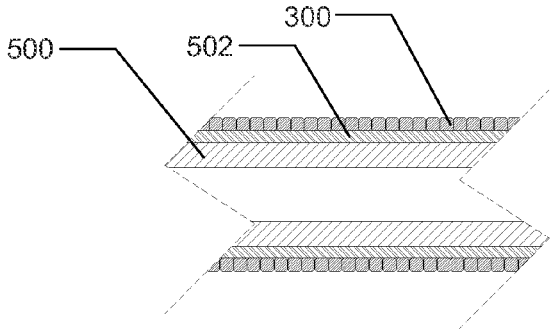
FIG. 6 shows an axial section of the jet lance.

Thrust liner 300 can be fabricated from heavy gage steel wire with a quadrilateral cross section, i.e., wire having a roughly square or rectangular cross section, which is wound as a helical spring having coils in solid contact. The winding pitch can be small, and adjacent surfaces of the wire coils should be in solid and continuous contact along the longitudinal axis of the thrust liner when the hose is straight. The square wire section can thus support a high compression load. As long as the helical spring of thrust liner 300 is straight and in compression as shown in FIG. 6, it will have an elastic modulus and buckling resistance comparable to a steel tube. This relatively high stiffness enables the assembly to be delivered into a long horizontal hole without buckling.

Figure 7:
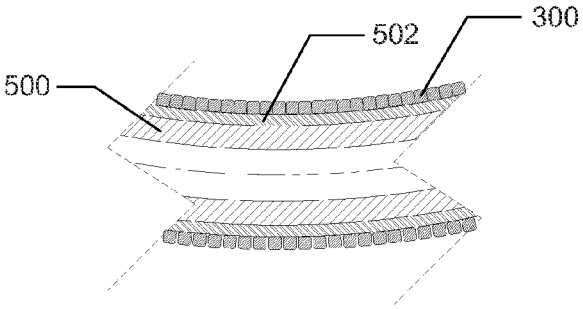
FIG. 7 shows an axial section of the jet lance in the curved configuration.

As shown in FIG. 7, when the flexible jet lance assembly is forced to bend in a curve when passing though the curved deflection shoe, the adjacent surfaces of the wire segments comprising the helical coil of thrust liner 300 separate slightly along the outer radius of the curve, but maintain contact along the inner radius. Any tendency of the hose to shear due to transverse sliding of the wire segments comprising the helical coil is resisted by spacer segments 502 and pressurized hose 500, which is flexible, but very stiff in the radial direction.

In an exemplary embodiment, the thrust liner has an outer diameter of 1-inch and is capable of withstanding 2000 lbf of thrust, without buckling or shearing. In this example, the jet drill has a gage diameter of about 1.125 inches and can drill a hole that is about 1.13-inches in diameter. The flexible jet lance in this example is 50-feet long. Those skilled in the art will recognize that maintaining a relatively low ratio between the hole diameter and the thrust enables the application of high thrust before the column becomes elastically unstable.

Tension cables 400 are disposed in gaps between the spacers, within the annulus between thrust liner 300 and pressurized hose 500. The spacers prevent the cables from all slipping to one side of the annulus and causing the lance to become asymmetric and unstable with respect to compressive or tensile loading. These tension cables are constructed of multi-wire steel, providing high flexibility and tensile strength. Further, the cables have sufficient tensile elasticity to accommodate relative changes in length as the lance assembly is bent though a radius, as shown in FIG. 4 and as is required, to pass though deflection shoe 120.

Figure 4:
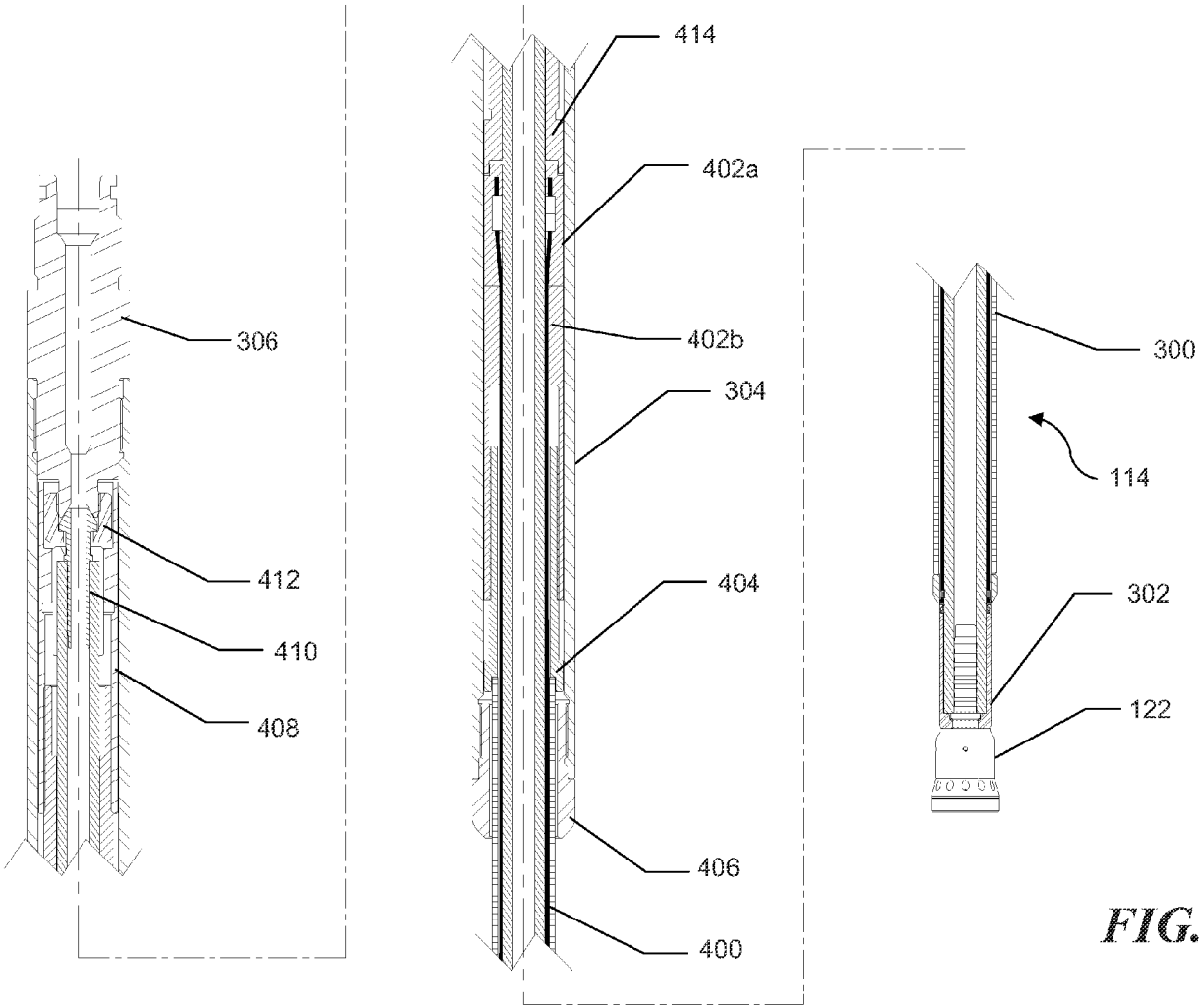
FIG. 4 shows the internal features of the jet lance and cable tensioner.

As shown in FIG. 4, tension cables 400 are attached to a hose fitting 302, which is disposed at the end of the flexible jet lance and to a retainer 402*a* inside cable tensioner assembly 114 (see FIG. 1A). Retainer 402*a* is free to move axially inside housing 304. A retainer support 402*b* is threadably engaged by a tensioner 404. Unthreading tensioner 404 applies tension to cables 400 and thrust to thrust liner 300. An end cap 406 is affixed to a distal end of housing 304. Pulling on tension assembly 114 stretches cables 400 so that tensioner 404 comes into contact with end cap 406, and the pulling force is transferred to the cables though tensioner 404, retainer support 402*b*, and retainer 402*a*. The cable pull force is applied through hose fitting 302 so that pulling on the tensioner assembly pushes thrust liner 300 upwards. This configuration makes it possible to pull flexible jet lance 116 and the attached jet drill out of the lateral borehole and out through the deflection shoe. In one exemplary embodiment, there are eight cables 400 for providing a tensile pull capacity of 4000 lbf. This load capacity enables the operator to observe variations in pull load, which can be an indication of hole instability.

A hose spacer 414 is threadably engaged with liner 408 to accommodate variability in the length of hose protruding from thrust liner 300. A crimped hose fitting 410 connects the hose to an inlet adaptor 306 of the tensioner assembly with a nut 412.

To summarize, flexible jet lance assembly 116 and tensioner assembly 114 provide a number of functions required for drilling a zero radius lateral bore, including: (1) transmitting high pressure fluid to the jet drill; (2) transmitting thrust to push the flexible jet lance assembly though the deflection shoe and to react the thrust of jet drilling and contact forces without shearing or buckling; (3) transmitting tension to pull the flexible jet lance out from the borehole; and, (4) providing sufficient transverse flexibility to pass though the deflection shoe passage as shown, with minimal thrust.

Figure 8C:
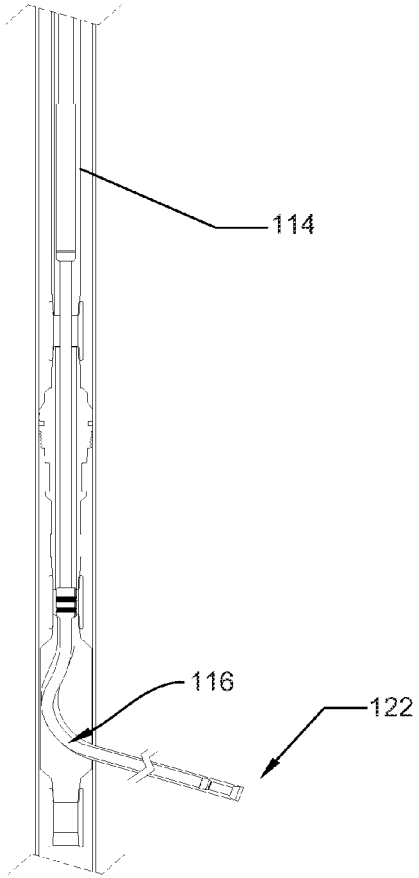
FIGS. 8A-8C show details of how the lance is deployed though the deflection shoe.
Figure 8B:
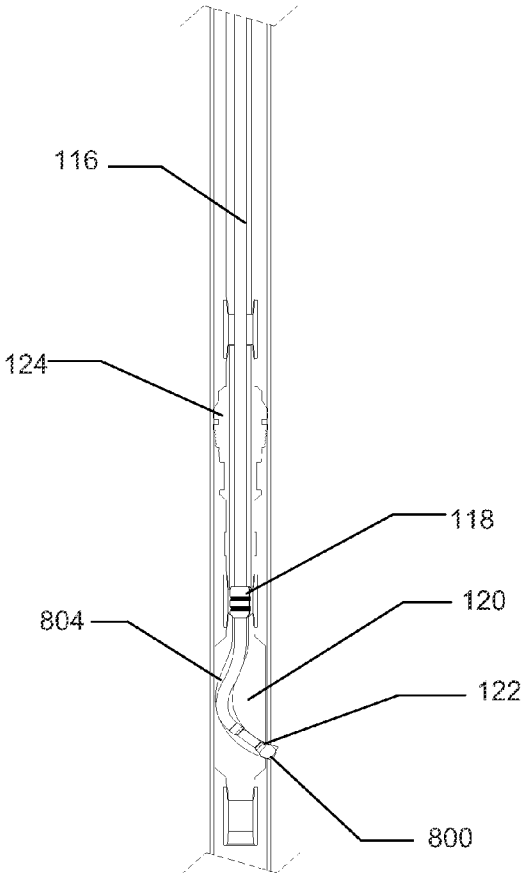
Figure 8A:
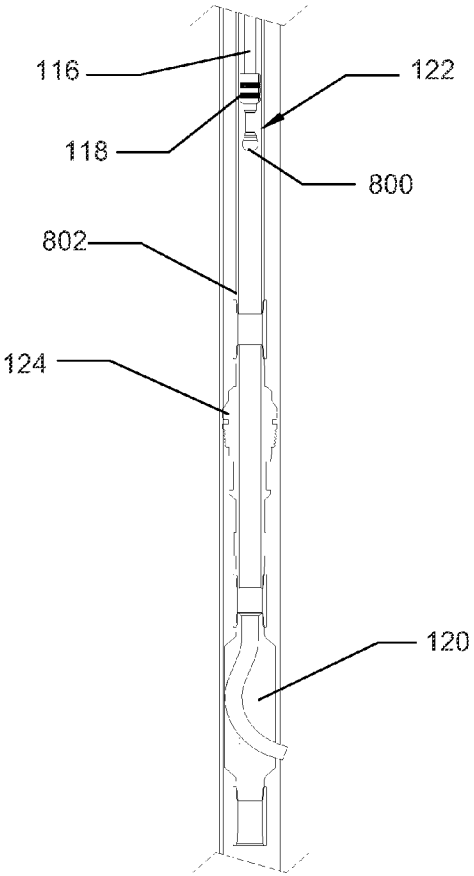

Referring to FIGS. 8A, 8B, and 8C, deflection shoe 120 is held fixed in the borehole by a packer 124, which is shown schematically. The packer may be mechanically set in the wellbore using a guide string 802. The packer and deflection shoe have previously been used to guide a flexible milling assembly, which is described in a commonly assigned provisional patent application Ser. No. 61/426,345 "Method and Apparatus for Milling a Zero Radius Window In Casing" and a corresponding utility patent application Ser. No. 13/328,111, which claims priority in that provisional application. The milling assembly disclosed in these two applications can be employed to mill a window or orifice through the well casing that is aligned with the deflection shoe exit.

Jet drill 122 is shown approaching the deflection shoe in FIG. 8A. At this point in the procedure, the jet drill is capped with a plastic cap 800, which is designed to ease the entry of the tool into the lateral direction through a curved passage 804 of the deflection shoe. A centralizer 118 is configured to slide on jet lance 116 and includes friction grips (not separately identified) on its outer surface that ensure the centralizer stays fixed in place, centrally disposed within casing 112, while the jet lance and jet drill are tripping into and out of the well.

A curved passage through deflection shoe 120 is smaller in diameter than the centralizer, so that the centralizer stops at a point immediately proximal to deflection shoe, as shown in FIGS. 1A and 8B. The jet lance advances through the shoe and the casing window until it tags the surrounding formation. When the flexible jet lance reaches this point, the weight indicator on the surface shows that the jet drill is in contact with the formation. Fluid is then pumped to the jet drill, which actuates the drill. The rotating high pressure jets on the jet drill erode through cap 800, enabling the drill to start drilling the lateral through the formation around the well casing. Thrust is continually applied to the jet drill so that it drills a gage hole into the formation as shown in FIG. 8C.

Those skilled in the art will recognize that the weight (or applied thrust) on the jet drill may be monitored by a sensor (not shown) on the surface and maintained as the assembly is fed into the well. In one exemplary method, lengths of high-pressure tubing 104 are added so that a block assembly 134 is at the top of its travel when initiating jet drilling as shown in FIG. 1A. The weight is maintained at a relatively constant level throughout the drilling process until the block assembly has moved to the bottom of its travel and the lateral is complete as shown in FIG. 1B. The lateral is thus completed in a single pass so that the gage diameter of the borehole is maintained at the minimum diameter required to accommodate the gage ring of the jet drill. A typical workover rig capable of providing this service can accommodate 60-feet of high pressure tubing and this length of tubing is the upper limit on the length of a lateral bore that may be drilled in a single pass. This procedure provides a uniform, minimum diameter hole. The buckling stability of the lance is inversely related to the clearance between the lance and the hole. Small increases in gage diameter will significantly reduce the resistance of the lance to buckling. Stopping to pull the jet drill out of the well can enlarge the lateral bore and reduce buckling stability. Accordingly, it may be preferable in this procedure to reduce the flow rate of fluid to the jet drill to the point where jet drilling stops before the jet drill and flexible jet lance are withdrawn from the lateral bore hole.

Although the concepts disclosed herein have been described in connection with the preferred form of practicing them and modifications thereto, those of ordinary skill in the art will understand that many other modifications can be made thereto within the scope of the claims that follow. Accordingly, it is not intended that the scope of these concepts in any way be limited by the above description, but instead be determined entirely by reference to the claims that follow.

An exclusive right is defined by the following claims:

1. Apparatus for drilling a lateral bore from within a well casing, comprising:

(a) a source of pressurized fluid;

(b) a high pressure hose that can be introduced into the well casing, for conveying a pressurized fluid down into the well casing;

(c) a jet lance that is flexible and includes a thrust liner spaced apart from and surrounding the high pressure hose, wherein the thrust liner circumferentially surrounds spacers and tension cables disposed circumferentially around the high pressure hose, and wherein the spacers provide a slip fit between the thrust liner and the high pressure hose, and the tension cables apply a tension force to the thrust liner, the thrust liner enabling the jet lance to bend around a curve within the well casing without shearing or buckling; and (d) a pressurized fluid jet drill that is coupled to a distal end of the jet lance, the pressurized fluid jet drill being actuated by the pressurized fluid to drill through a formation that surrounds the well casing to form the lateral bore.

2. The apparatus of claim 1, further comprising a high pressure fluid swivel that is coupled between the source of pressurized fluid and the high pressure hose, enabling rotation of the high pressure hose and the pressurized fluid jet drill within the well casing.

3. The apparatus of claim 1, further comprising a cable tensioner that is introduced with the high pressure hose into the well casing, the cable tensioner being capable of supporting the pressurized fluid jet drill.

4. The apparatus of claim 1, further comprising a packer that can be removably affixed within the well casing at a desired elevation.

5. The apparatus of claim 4, further comprising a deflection shoe that is supported from a distal end of the packer within the well casing and is positioned at a point where an orifice has been formed within the well casing to enable the pressurized fluid jet drill to be advanced into contact with a surrounding formation to drill the lateral bore, the deflection shoe including a curved passage to guide the pressurized fluid jet drill toward the orifice and surrounding formation.

6. The apparatus of claim 5, wherein the thrust liner comprises a helical coil of generally square cross section wire formed of steel that is wound so that coils of the helical coil are in continuous contact along their adjacent surfaces when the high pressure hose within the thrust liner is straight, providing an elastic modulus and buckling resistance comparable to a steel tube, but separate from each other on an outer radius of a curve, remaining in contact on an inner radius of the curve, when the flexible jet lance is forced to bend as the flexible jet lance travels through the curved passage in the deflection shoe.

7. The apparatus of claim 1, further comprising a cap disposed over a distal end of the high pressure fluid jet drill to ease entry of the distal end in a lateral direction through a curved passage, to protect a face of the pressurized fluid jet drill during its deployment through the well casing, and to prevent wellbore fluid from flowing into the pressurized fluid jet drill, wherein the cap is removed when the pressurized fluid jet drill is actuated to begin drilling the lateral bore.

8. The apparatus of claim 1, wherein the source of pressurized fluid is actuated to deliver the pressurized fluid to the pressurized jet drill in response to a change in weight of the high pressure hose, the flexible jet lance, and the pressurized fluid jet drill, when a distal end of the pressurized fluid jet contacts the formation through which the lateral bore is to be drilled.

9. A flexible jet lance for assisting in jet drilling a lateral bore, comprising:

(a) an outer thrust element having a relatively high compressive stiffness along a longitudinal axis of the and a relatively low transverse stiffness, the outer thrust element conveying a thrust to a jet drill attached to the flexible jet lance, even as the flexible jet lance is forced around a curve to enter the lateral bore;

(b) an inner hose capable of carrying fluid at high pressure, for activating a jet drill for drilling the lateral bore;

(c) a plurality of arc-shaped spacers disposed within an annulus between the outer thrust element and the inner hose; and (d) a plurality of flexible tensile elements disposed within the annulus, between adjacent arc-shaped spacers, the flexible tensile elements providing sufficient tension to pull the flexible jet lance from within a lateral bore.

10. The flexible jet lance of claim 9, where the outer thrust element comprises a helical spring wound of wire having a quadrilateral cross section.

11. The flexible jet lance of claim 9, wherein the inner hose comprises at least two layers of wire reinforcement wrapped around an impermeable inner liner.

12. The flexible jet lance of claim 9, wherein the arc-shaped spacers comprise a polymeric material.

13. The flexible jet lance of claim 10, wherein said wire is formed of steel.

14. The flexible jet lance of claim 9, where said flexible tensile elements are constructed of multi-wire steel cable, characterized by a high flexibility and a high tensile strength.

15. The flexible jet lance of claim 9, further comprising a cable tensioning mechanism to selectively apply the to the plurality of flexible tensile elements.

16. The flexible jet lance of claim 9, wherein the outer thrust element transmit the thrust from a length of tubing suspended in a well to a jet drill that is disposed at a distal end of the flexible jet lance.

17. The flexible jet lance of claim 9, wherein the flexible tensile elements transmit tension from a length of tubing suspended in a well to a distal end of the flexible jet lance.

18. A method for drilling a lateral bore in the earth from inside a well casing, comprising:

(a) setting a deflection shoe inside the well casing, proximate to a position through which the lateral bore will extend laterally from the well casing;

(b) milling a window in the well casing, and aligning an exit of the deflection shoe with the window;

(c) lowering a flexible jet lance having a jet drill coupled to a distal end of the flexible jet lance, so that a distal end of the jet drill advances through a passage within the deflection shoe, out the exit, and through the window milled in the well casing; and (d) supplying a pressurized fluid to the jet drill through a high pressure hose that extends through the flexible jet lance, while applying a thrust to the jet drill through a thrust liner of the flexible jet lance, the thrust liner and a tension applied to the flexible jet lance by a tensioner assembly that includes tension cables, enabling the flexible jet lance to bend around the passage within the deflection shoe and into the lateral bore without shearing or buckling, wherein the thrust liner circumferentially surrounds spacers and the tension cables that are disposed circumferentially around the high pressure hose, the pressurized fluid and the thrust applied by the flexible jet lance causing the jet drill to drill the lateral bore in a formation external to the well casing and adjacent to the window.

19. The method of claim 18, further comprising maintaining a generally constant weight and thereby, a generally constant thrust, which is applied through the flexible jet lance to the jet drill as the lateral bore is being drilled.

20. The method of claim 18, further comprising the step of reducing a flow rate of pressurized fluid to the jet drill where the drilling stops, before withdrawing the jet drill and flexible jet lance from the lateral bore to avoid enlarging the lateral bore, which might reduce a buckling stability of the flexible jet lance.

21. The method of claim 18, further comprising providing a protective cap over a face of the jet drill, to protect the face as the jet drill is tripping into the well casing and through the passage in the deflection shoe.

22. Apparatus for drilling a lateral bore from within a well casing, comprising:

(a) a source of pressurized fluid;

(b) a high pressure hose that can be introduced into the well casing, for conveying a pressurized fluid down into the well casing;

(c) a jet lance that is coupled to a distal end of the high pressure hose;

(d) a packer that can be removably affixed within the well casing at a desired elevation;

(e) a pressurized fluid jet drill that is coupled to a distal end of the jet lance, the pressurized fluid jet drill being actuated by the pressurized fluid to drill through a formation that surrounds the well casing to form the lateral bore; and (f) a deflection shoe that is supported from a distal end of the packer within the well casing and is positioned at a point where an orifice has been formed within the well casing to enable the pressurized fluid jet drill to be advanced into contact with a surrounding formation to drill the lateral bore, the deflection shoe including a curved passage to guide the pressurized fluid jet drill toward the orifice and surrounding formation.

* * * * *